United States Patent [19]

Kitazawa

[11] Patent Number: 5,014,401

[45] Date of Patent: May 14, 1991

[54] SEAT BELT SYSTEM

[75] Inventor: Yasuho Kitazawa, Niwa, Japan

[73] Assignee: Kabushiki Kaisha Tokai-Rika-Denki Seisakusho, Japan

[21] Appl. No.: 396,666

[22] Filed: Aug. 22, 1989

[30] Foreign Application Priority Data

Aug. 24, 1988 [JP] Japan ..... 63-110851[U]

[51] Int. Cl.[5] ..... A44B 11/26

[52] U.S. Cl. ..... 24/633; 24/641

[58] Field of Search ..... 24/633, 634, 636, 637, 24/638, 639, 642, 651, 652, 657

[56] References Cited

U.S. PATENT DOCUMENTS

| | | | |
|---|---|---|---|
| 4,404,715 | 9/1983 | Sugimoto | 24/633 |
| 4,454,634 | 6/1984 | Haglund et al. | 24/636 |
| 4,550,474 | 11/1985 | Doty et al. | 24/633 |
| 4,575,907 | 3/1986 | Takada | 24/641 |

FOREIGN PATENT DOCUMENTS

| | | |
|---|---|---|
| 62-78109 | 5/1987 | Japan . |
| 62-203608 | 12/1987 | Japan . |
| 63-153807 | 10/1988 | Japan . |
| 63-153808 | 10/1988 | Japan . |

*Primary Examiner*—Victor N. Sakran
*Attorney, Agent, or Firm*—Oliff & Berridge

[57] ABSTRACT

A seat belt system has a plurality of seat belt units with buckle apparatuses each having a tongue plate and a buckle plate for receiving and engaging the tongue plate. The seat belt system includes a first tongue plate having a first insert portion, a first buckle body having a first ejector movable by the insertion of the first insert portion and a first lock plate operative in response to the movement of the first ejector and capable of locking the first insert portion, a second tongue plate having a second insert portion, and a second buckle body having a second ejector movable by the insertion of the second insert portion and a second lock plate operative in response to the movement of the second ejector and capable of locking the second insert portion. The first buckle body has a first insertion path with a restricted portion of a width smaller than that of the second insert portion. The lengths of the first and second insert portions in the direction of insertion and the lengths of the first and second ejectors in the direction of movement of the ejectors are determined to meet the conditions of: direction of length of first insert portion plus movable direction length of first ejector = direction of length of second insert portion plus movable direction length of second ejector; direction of length of second insertion portion > direction of length of first insert portion; and movable direction length of first ejector > movable direction length of second ejector. With this arrangement, erroneous insertion of the second tongue plate into the first buckle body is prevented, while erroneous insertion of the first tongue plate into the second buckle body cannot activate the lock plate in the second buckle body.

17 Claims, 6 Drawing Sheets

SEAT BELT SYSTEM

BACKGROUND OF THE INVENTION

1. Field of the Invention

The present invention relates to a seat belt system having a plurality of buckle apparatus.

2. Description of the Related Art

An ordinary seat belt system is constructed so that a seat occupant, after being seated on a seat, brings a tongue plate on an end of a restraining webbing into engagement with a buckle body so that the seat occupant is restrained to the seat.

When using a seat belt system having a plurality of buckle apparatus, a tongue plate on a restraining webbing for a seat occupant may be brought into engagement with the buckle body of another buckle apparatus intended for another seat occupant. Erroneous fitting of a tongue plate in a wrong buckle body therefore tends to occur in seat belt systems having a plurality of buckle apparatus.

In order to overcome this problem, Japanese Utility Model Application No. 60-170590 discloses a seat belt system having a plurality of seat belt units, wherein the tongue plates of different buckle apparatuses are provided with projections at different positions while mating recesses are formed in buckle bodies of different buckle apparatuses such that each tongue plate can engage only with the buckle body of the same buckle apparatus.

The above-described known seat belt system, however, suffers from a problem in that the appearance of the seat belt system is impaired due to the irregularlity of appearances of the tongue plates and buckle bodies. In addition, the use of different shapes of tongue plates and buckle bodies makes it difficult to standardize the design of parts or common use of the parts by different buckle apparatuses.

SUMMARY OF THE INVENTION

Accordingly, an object of the present invention is to provide a seat belt system of the type having a plurality of buckle apparatus, wherein different tongue plates and hence, different buckle bodies have substantially the same configurations but yet are capable of preventing wrong insertion of the tongue plates.

To this end, according to one aspect of the present invention, there is provided a seat belt system having a plurality of buckle apparatuses each including a tongue plate supporting a webbing and a buckle body for locking the tongue plate, comprising: a first tongue plate having a first insert portion; a first buckle body having a first insertion path along which the first insert portion of the tongue plate is inserted, a first ejector of the first buckle body, movable in the direction of insertion of the first insert portion by being pushed by the first insert portion inserted along the first insertion path, and a first lock plate operable by the movement of the first ejector so as to be engaged with the first insert portion thereby locking the first tongue plate; a second tongue plate having a second insert portion; a restricted portion provided in the first insertion path and having a width smaller than the width of the second insert portion; and a second buckle body having a second insertion path along which the second insert portion is inserted, a second ejector of a second buckle body movable by a predetermined amount in the direction of insertion of the second insert portion by being pushed by the second insert portion inserted along the second insertion path, and a second lock plate operable by the movement of the predetermined amount of the second ejector so as to be engaged with the second insert portion thereby locking the second tongue plate, the length of the first insert portion in the direction of insertion and the length of the second ejector in the direction of movement of the second ejector being determined such that, when the first insert portion is inserted into the second insert path, the amount of movement of the second ejector caused by the insertion of the first insert portion is smaller than the predetermined amount.

When the first insert portion of the first tongue plate of the first buckle device is inserted into the first buckle body of the first buckle apparatus; the first insert portion operates the first lock plate through the action of the first ejector so as to be locked by the lock plate of the first buckle body. Similarly, when the second insert portion of the second tongue plate of the second buckle apparatus is inserted into the second buckle body of the second buckle apparatus, the second insert portion operates the second lock plate through the action of the second ejector of the second buckle body so as to be locked by the lock plate of the second buckle unit.

When the second insert portion of the second tongue plate is erroneously inserted into the first buckle body the second insert portion is blocked by a restricting portion provided in a first insertion path formed in the first buckle body, so that the second insert portion is never locked in the first buckle body.

When the first insert portion of the first tongue plate has been erroneously inserted into the second buckle body, the first insert portion cannot move the second ejector of the second buckle body to the position where the second ejector operates the second lock plate, because the length of the first insert portion in the direction of insertion and the length of the second ejector in the direction of movement of the second ejector are determined such that the movement of the second ejector caused by the insertion of the first insert portion cannot cause a predetermined amount of movement of the second ejector necessary for completely operating the second lock plate. In this case, therefore, the first tongue plate is not locked by the second lock plate of the second buckle body.

It is therefore possible to avoid insertion of each tongue plate into wrong buckle units.

DESCRIPTION OF THE PREFERRED EMBODIMENTS

Figure 1:
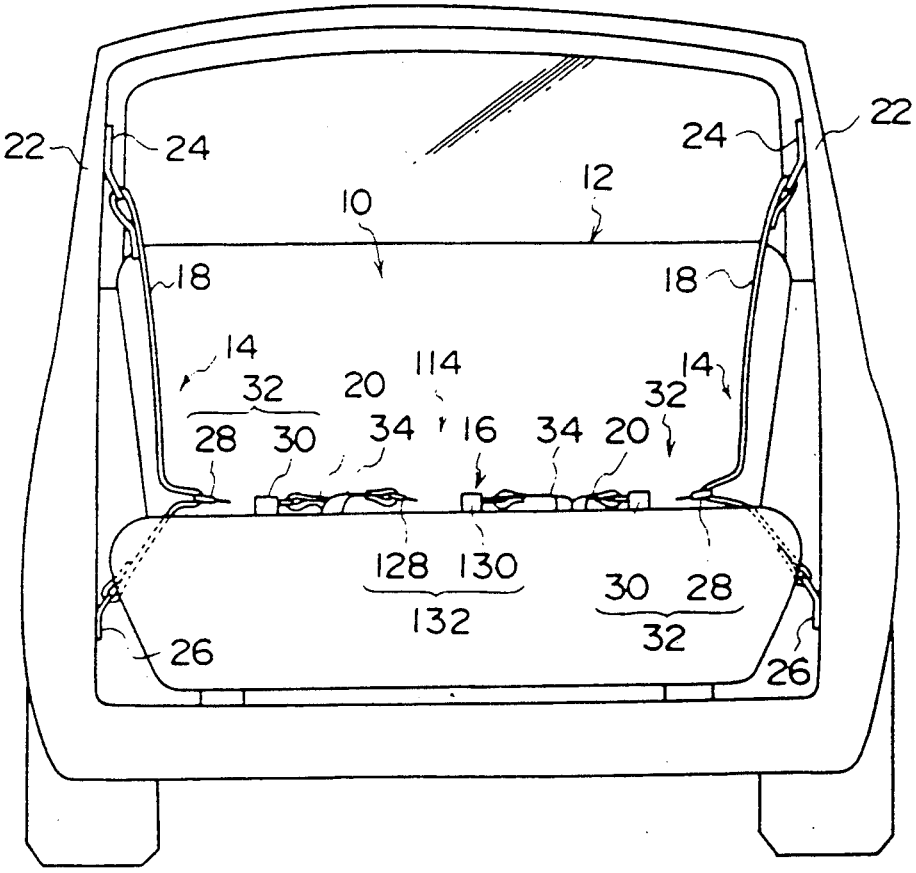
FIG. 1 is an illustration of the whole portion of a seat belt system in accordance with the present invention.

FIG. 1 illustrates a rear seat of an automobile equipped with a seat belt system 10 of the present invention.

The rear seat 12 is of a bench type and is designed to allow three passengers to be seated thereon. The seat belt system 10 has three seat belt units: namely, a pair of first seat belt units 14 of a 3-point type for passengers on the left and right and a second seat belt unit 114 of a chest-restraining type for the central passenger.

Each of the first seat belt units 14 is provided with an outer webbing 18 and an inner webbing 20. The outer webbing has one end anchored by an anchor plate 24 that is fixed to an upper portion of a quarter pillar 22. The other end is anchored by an anchor plate 26 fixed to a portion of the chassis near the rear seat 12. A tongue plate 28 is slidably attached to an intermediate portion of the outer webbing 18. The first seat belt unit 14 also has a buckle body 30 corresponding to the tongue plate 28. One end of the inner webbing 20 is connected to the buckle body 30. The tongue plate 28 and the buckle body 30 in cooperation provide a first buckle apparatus 32.

The inner webbing 20 extends through a slit (not shown) formed in the rear seat 12. The outer end of the inner webbing 20 is fastened to the chassis.

On the other hand, the second seat belt unit 114 of the chest-retaining type for the center passenger has a pair of webbings 34. These webbings 34 are fastened to the chassis at portions beneath the rear seat 12 in the same manner as that in the 3-point type seat belt unit described above. The other ends of the webbings 34 are connected, respectively, to a tongue plate 128 and a buckle body 130. The tongue plate 128 and the buckle body 130 in cooperation constitute a second buckle apparatus 132.

Thus, there are three tongue plates 28, 28, 128 and three buckle units 30, 30, 130 left in a random manner on the rear seat 12. The tongue plates 28 and 128 of the first and second buckle apparatuses 32 and 132 are substantially the same in their construction. Similarly, the buckle units 30 and 130 of the first and second buckle apparatuses 32 and 132 are substantially the same in their construction. Thus, the first and the second buckle apparatuses 32 and 132 are the same in construction, except that some of the components of these buckle apparatuses are different in dimension. The following description therefore will be focused mainly on the first buckle apparatus 32.

Figure 2:
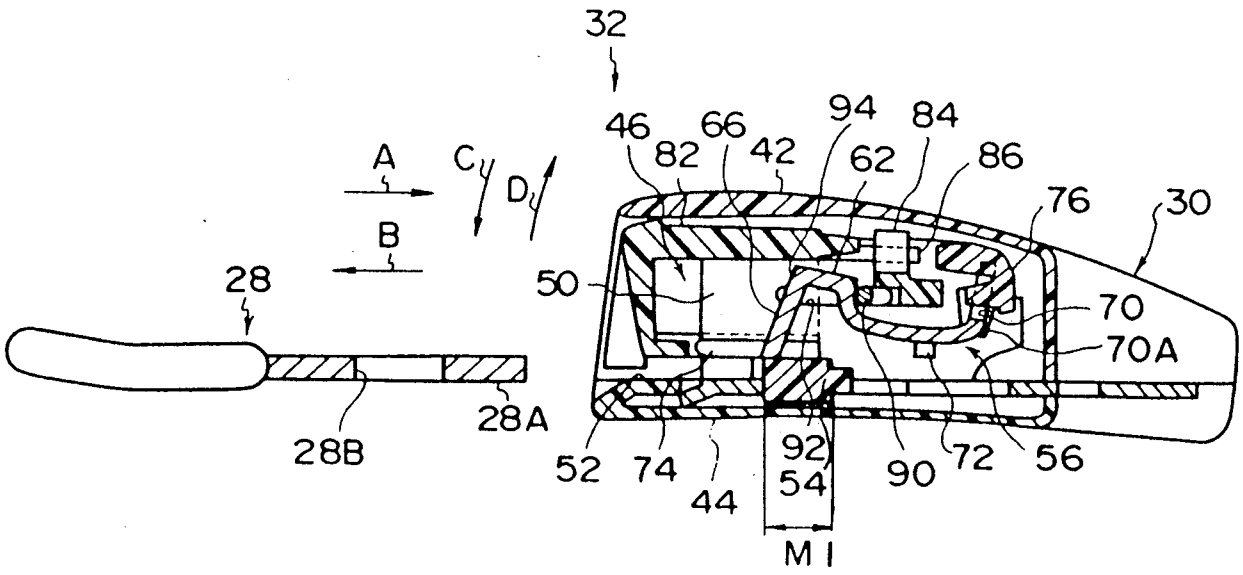
FIGS. 2 and 3 are longitudinal sectional views of a first buckle apparatus incorporated in the seat belt system of FIG. 1.
Figure 3:
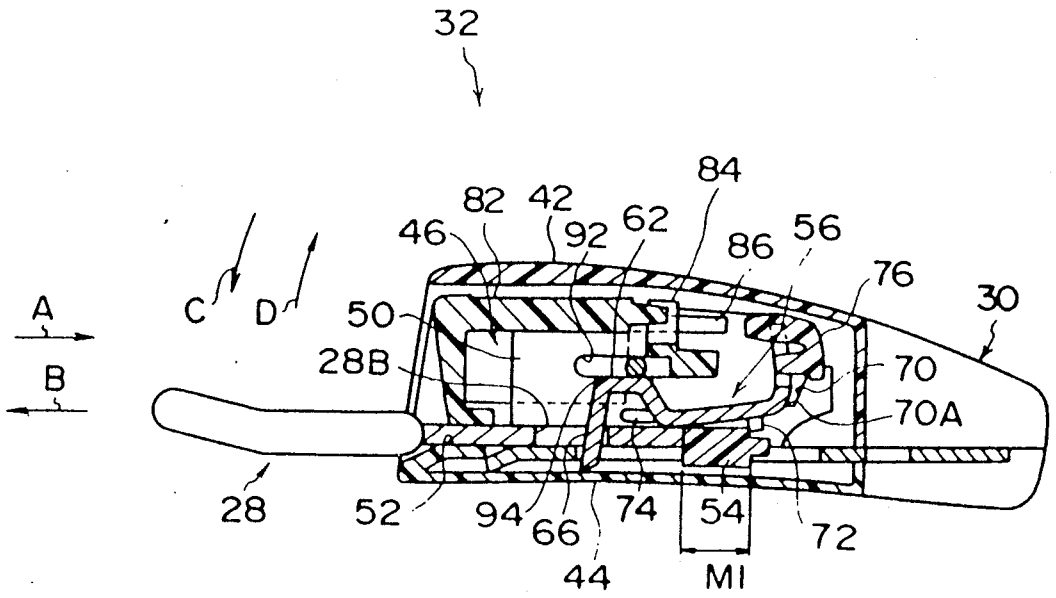
Figure 4:
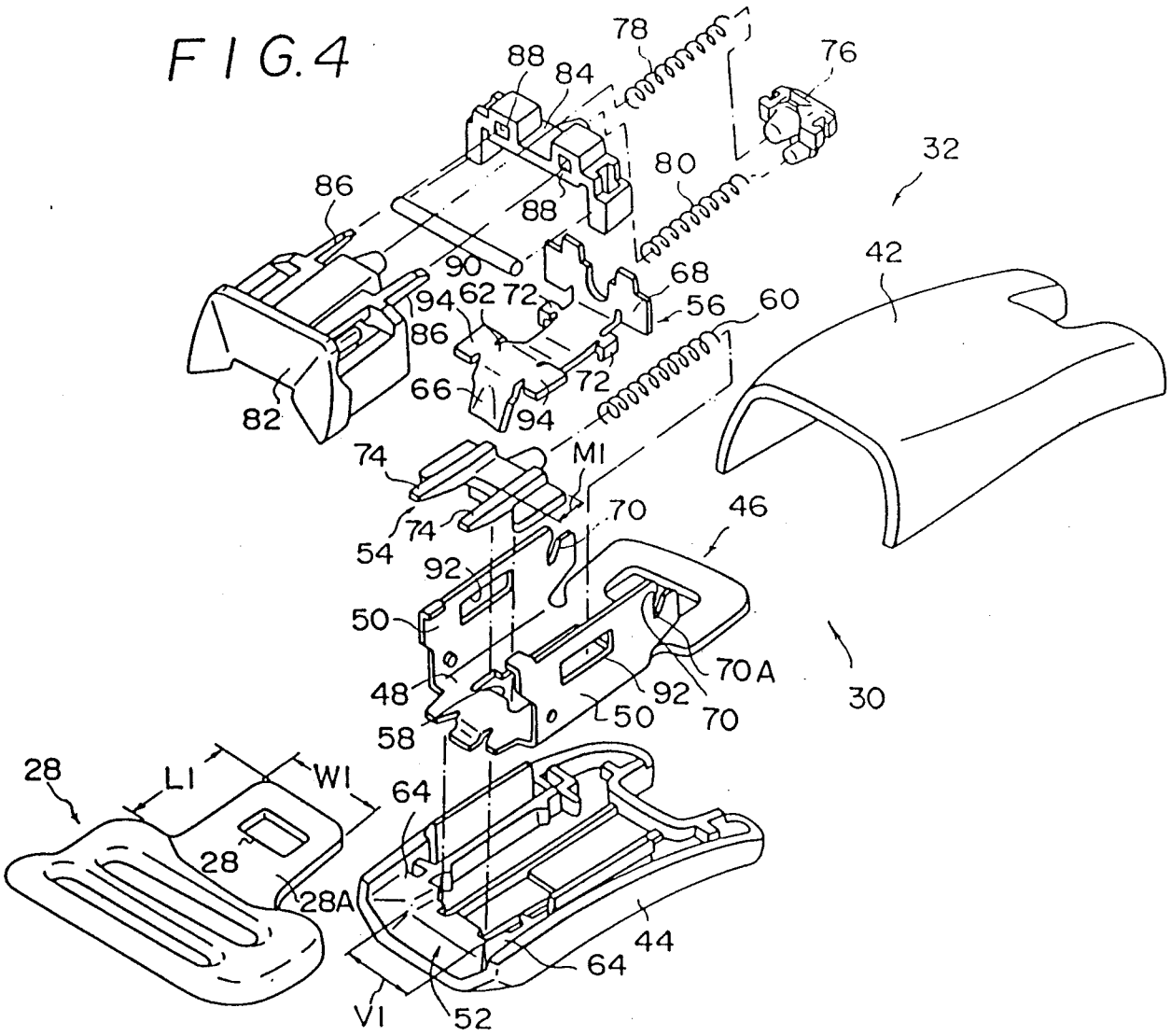
FIG. 4 is an exploded perspective view of the buckle apparatus.

FIGS. 2 to 4 illustrate the first buckle apparatus 2 used in the first seat belt unit 14. The buckle body 30 of the first buckle apparatus 32 has, as shown in FIG. 2, has a buckle member 46 interposed between an upper cover 42 and a lower cover 44. As will be seen from FIG. 4, the buckle member 46 has a flat portion 48 and a pair of leg portions 50 bent longitudinally from both breadthwise ends of the flat portion 48. The arrangement is such that an insert portion 28A of the tongue plate 28 is inserted into the space between the pair of leg portions 50 through an opening 52 formed between the upper cover 42 and the lower cover 44. The lower cover 44 is integrally formed from a plastic material and is provided with a pair of breadthwise projections 64 formed on the opposing inner surfaces thereof near the above-mentioned opening 52, as can be seen in FIG. 4.

Figure 5:
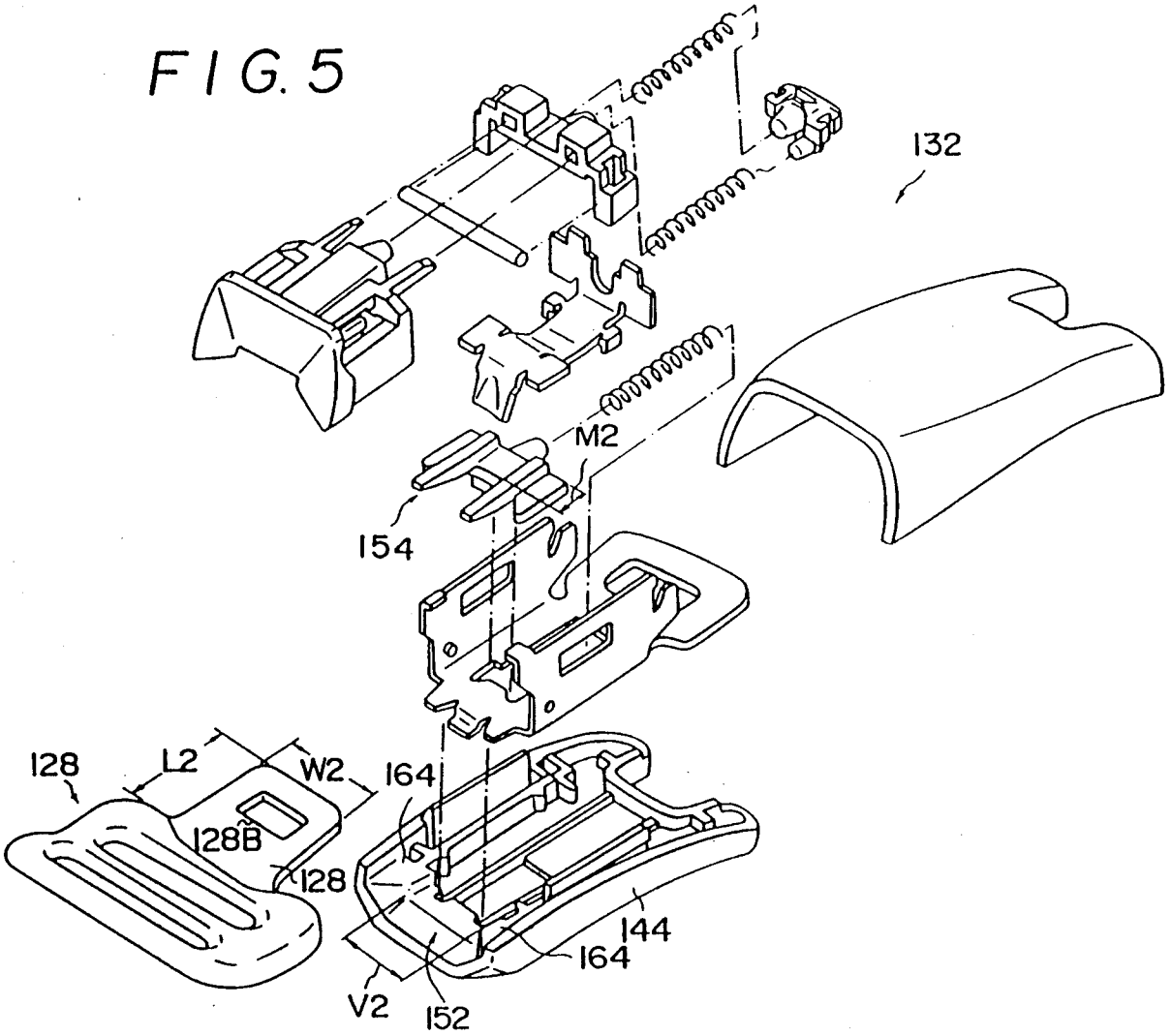
FIG. 5 is an exploded perspective view of a second buckle apparatus employed in the seat belt system shown in FIG. 1.

The projection 64 has a projection length which is smaller than that of similar projections 164 formed in the lower cover 144 of the second buckle device 132 shown in FIG. 5. Thus, the distance V1 between the ends of the projections 64 is greater than the distance V2 between the projections 164 on the lower cover 144 of the second buckle apparatus 132 shown in FIG. 5.

The insert portion 28A of the tongue plate 28 has a length L1 which is greater than the length L2 of the insert portion 128A of the tongue plate 128 of the second seat belt unit 114. The width W1 of the insert portion 28A of the tongue plate 28 is greater than the width W2 of the insert portion 128A of the tongue plate 128. The width W1 of the insert portion 28A of the tongue plate 28 is determined to be greater than the distance V2 between the projections 164.

As will be seen from FIG. 2, an ejector 54 and a lock plate 56 are provided between the pair of leg plates 50 of the buckle member 46.

The ejector 54 is disposed in a guide hole 58 formed in the flat portion 48 of the buckle member 46 so as to be movable in the direction of insertion and withdrawal of the tongue plate (in the directions of arrows A and B in FIGS. 2 and 3). A compression spring 60 (see FIG. 4) has one end retained by the buckle member 46, while the other end of this compression spring 60 fits on the inner end of the ejector 54 as viewed in the direction of insertion of the tongue plate (in the direction of the arrow A in FIGS. 2 and 3). The compression spring 60 urges the ejector 54 in the direction of withdrawal of the tongue plate indicated by the direction of arrow B in FIGS. 2 and 3.

When the insert portion 28A of the tongue plate 28 is inserted into the buckle member 46, the end of the insert portion 28A abuts the ejector 54. The tongue plate 28, which is in a disengaged state as shown in FIG. 2, is moved into the buckle member 46 while forcibly urging the ejector 54 in the insertion direction (in the direction of the arrow A in FIG. 2) as shown in FIG. 3. The length M1 of the ejector 54 as measured in the direction of insertion of the tongue plate 128 is smaller than the length M2 of the ejector 154 of the second seat belt apparatus 114.

A lock plate 56 extends longitudinally in the direction of insertion and withdrawal of the tongue plate 28 (in the direction of the arrows A and B in FIGS. 2 and 3) and has an distal end portion, i.e., the end in the direction of withdrawal shown by the arrow B in FIGS. 2 and 3, orthogonally bent downward so as to form a substantially U-shaped portion 62. The insert portion 28A of the tongue plate 28 is notched so as to provide an engaging hole 28B. The distal end of the U-shaped portion 62 provides an engaging portion 66 that is engageable with the engaging hole 28B. Namely, the end of the engaging portion 66 fits into the engaging hole 28B in a manner shown in FIG. 3, thus accomplishing engagement between the tongue plate 28 and the buckle body 30.

The U-shaped portion 62 of the lock plate 56 is provided at its inner end, i.e., the end as viewed in the direction of insertion of the tongue plate 28 (in the direction of the arrow A in FIGS. 2 and 3), with an upward rising portion 68. As will be seen from FIG. 4, the rising portion 68 has a large width in the direction of the width of the lock plate 56. Thus, the lock plate 56 bridges the pair of leg portions 50 of the buckle member 46 in such a manner that the ends of the rising portion 68 of the lock plate 56 as viewed in the direction of the width of the lock plate rest on the leg portions 50 of the buckle member 46. The leg portions 50 are provided at their inner ends, i.e., the ends in the direction of insertion of the tongue plate 28 (in the direction of the arrow A in FIGS. 2 and 3) with notches 70 which receive the widthwise ends of the rising portion 68 of the lock plate 56 so that the lock plate 56 is rockable about the bottoms 70A of the notches 70 in the directions (arrows C and D in FIGS. 2 and 3) into and out of engagement with the tongue plate 28.

As will be seen from FIG. 4, the lock plate 56 has a downward bent portion 72 formed at a longitudinally intermediate portion between the U-shaped portion 62 and the rising portion 68. When the bent portion 72 is pressed in the direction of insertion of the tongue plate 28 (in the direction of the arrow A in FIG. 2) from the withdrawn state shown in FIG. 2, the lock plate 56 rocks in the direction for bringing the tongue plate 28 into engagement (in the direction of the arrow C in FIG. 2). The bent portion 72 corresponds to the inner end, i.e., the end in the direction of insertion of the tongue plate 28 (the arrow A in FIGS. 2 and 3) of a block 74 which is provided integrally on the upper surface of the ejector 54. The arrangement is such that, when the tongue plate 28 is moved in the direction of insertion from the disengaged state shown in FIG. 2, the ejector 54 presses the bent portion 72 in the direction of insertion of the tongue plate 28 (in the direction of the arrow A in FIG. 2) so as to cause the lock plate 56 to rock in the direction for engagement with the tongue plate 28 (in the direction of the arrow C in FIG. 2) while being moved in the direction of insertion of the tongue plate 28, as shown in FIG. 3.

The length L2 of the insert portion 128A of the tongue plate 128 and the length M1 of the ejector 54 in the direction of insertion are so determined that, when the insert portion 128A of the tongue plate 128 is erroneously inserted into the buckle body 30 of the first seat belt unit 14, the ejector 54 is never moved to the position where it can press the bent portion 72 of the lock plate 56, even though the ejector 54 is pressed by the insert portion 128A of the tongue plate 128.

More specifically, in this embodiment, the dimensions are so determined that the sum of the length L1 of the insert portion 28A of the tongue plate 28 and the length M1 of the ejector 54 in the direction of insertion of the tongue plate 28 is greater than the length L2 of the insert portion 128A of the tongue plate 128 and the length M2 of the ejector 154 in the direction of insertion of the tongue plate 128.

As a result of the rocking motion of the lock plate 56, the end of the engaging portion 66, as seen in FIG. 2, is moved into the engaging hole 28B thereby achieving engagement between the tongue plate 28 an the lock plate 56.

The lock plate 56 is provided with a spring retainer 76 secured to the rising portion 68 thereof. The spring retainer 76 retains one end of a pair of coiled compression springs 78, 80 (see FIG. 4) the other ends of which are retained by a release button 82 and a lock pin holder 84, respectively, at positions which are on the outer side of the spring retainer 76, i.e., at the side offset from the spring retainer 76 in the direction of withdrawal of the tongue plate 28 (in the direction of the arrow B in FIGS. 2 and 3). Thus, the release button 82 and the lock pin holder 84 are urged by the coiled compression springs 78, 80 in the direction of withdrawal of the tongue plate 28 (in the direction of the arrow B in FIGS. 2 and 3).

The release button 82 is provided at a position which is offset from the lock pin holder 84 in the direction of withdrawal of the tongue plate 28 (in the direction of the arrow B in FIGS. 2 and 3) for movement in the directions of insertion and withdrawal of the tongue plate (in the directions of the arrows A and B in FIGS. 2 and 3). The release button 82 is movable in the direction of insertion of the tongue plate 28 (in the direction of the arrow A in FIGS. 2 and 3) against the urging force of the coiled compression spring 78 (see FIG. 4). A block 86 is provided on the end of the release button 82 in the direction of insertion of the tongue plate 28 (in the direction of the arrow A in FIGS. 2 and 3) so as to project in the direction of insertion of the tongue plate 28 (in the direction of the arrow A in FIGS. 2 and 3).

The block 86 extends through a rectangular hole 88 (see FIG. 4) provided on the upper end of the lock pin holder 84 for movement in the axial direction so as to correspond to the upper end of the rising portion 68 of the lock plate 56. When the release button 82 is moved in the direction of insertion of the tongue plate 28 (in the direction of the arrow A in FIG. 3) against the urging force of the coiled compression spring 78 (see FIG. 4) while the tongue plate 28 is in engaged state as shown in FIG. 3, the block 86 abuts and pushes the upper end of the rising portion 68 of the lock plate 56 so as to cause the lock plate 56 to swing in the direction for disengaging the tongue plate 28 (in the direction of the arrow D in FIG. 3). As a result of this swinging motion of the lock plate 56, the engaging portion 66 of the lock plate 56, which has been held in engagement with the engaging hole 28B of the tongue plate 28 as shown in FIG. 3, is disengaged from the engaging hole 28B.

When the tongue plate 28 is held in engagement, the lock pin holder 84 is urged by the coiled compression spring 80 (see FIG. 4) so as to cooperate with a release button 82 in clamping therebetween a lock pin 90 as an auxiliary lock member at the outside of the leg portions 50 of the buckle member 46, as shown in FIG. 2. The lock pin 90 is carried at its both axial ends in hearing holes 92 formed in the leg plates 50 of the buckle member 46 so as to be supported by the buckle member 46. The bearing holes 92 are elongated in the horizontal direction of insertion and withdrawal of the tongue plate 28 (in the direction of arrows A and B in FIGS. 2 and 3) so as to supportably allow the lock pin 90 to move in these directions.

The lock pin 90 is arranged to face a corresponding locating plate portion 94 provided on the lock plate 56. As shown in FIG. 4, the locating plate portion 94 is extended in the direction of breadth of the lock plate 56 from an intermediate portion of the U-shaped portion 62 and is substantially perpendicular to the engaging portion 66. When the tongue plate 28 is in engagement with the lock plate 56, the lock pin 90 corresponds to the upper surface of the locating plate portion 94 as shown in FIG. 3. In the state after withdrawal of the tongue plate, the lock pin 90 corresponds to the end surface of the locating plate portion 94 in the direction of insertion of the tongue plate 28 (in the direction of the arrow A of FIG. 2) as shown in FIG. 2.

The operation of this embodiment will be described hereinafter.

It is assumed here that even if a passenger on the rear seat, who wishes to use one of the first seat belt units 14, tries to insert the tongue plate 28 of the first seat belt unit 14 wrongly into the buckle body 130 of the second seat belt unit 114, it will fail because the insert portion 28A of tongue plate prevents the projections 164 from coming into the lower cover 144 due to the fact that the width W1 of the insert portion 28 of the tongue plate 28 is greater than the length V2 of the opening 152 of the lower cover 144. It is thus possible to avoid erroneous insertion of the tongue plate 28 into the buckle body 130.

Figure 6:
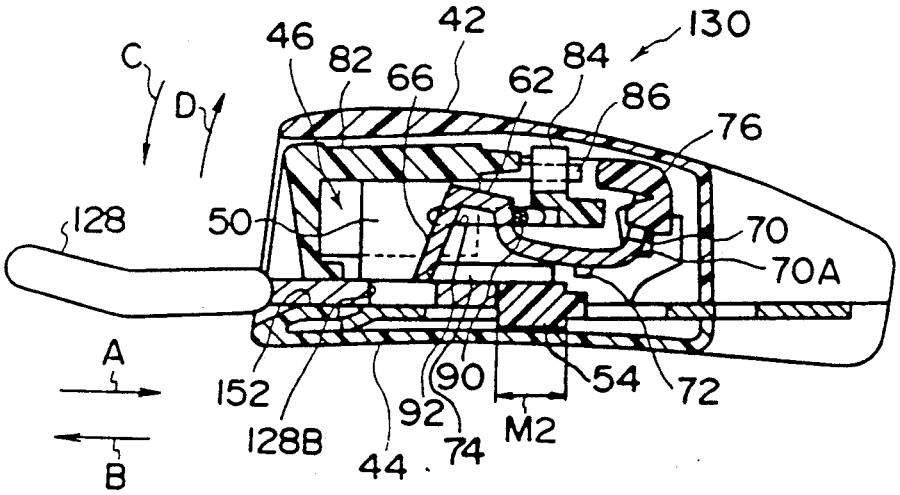
FIG. 6 is a longitudinal sectional view of a buckle apparatus in a state in which the tongue plate of the second buckle apparatus is erroneously inserted into the buckle body of a first buckle apparatus.

It is also assumed here that if a passenger on the rear seat, who wishes to use the second seat belt unit 114, has happened to try to erroneously insert the insert portion 128A of the tongue plate 128 of the second seat belt unit 114 into the buckle body 30 of the first seat belt unit 14, it will fail. Since the width W2 of the insert portion 128A of the tongue plate 128 is smaller than the width of the opening in the lower cover 44, the insert portion 128A is received in the buckle body 30 of the first seat belt unit 14. In this case, however, the length L2 of the insert portion 128A of the tongue plate 128 is configured smaller than the length L1 of the insert portion 28A of the tongue plate 28. In addition, the ejector 54 has a length M1 which is smaller than the length M2 of ejector 154. In consequence, as seen in FIG. 6, even though the insert portion 128A of the tongue plate 128 presses the ejector 54, it does not cause the ejector 54 to move to a position where it presses the bent portion 72 of the lock plate 56 so as to cause the lock plate 56 to rotate in the direction of the arrow C in FIG. 2. It is therefore possible to prevent the tongue plate 128 of the second seat belt unit 114 from being locked in the buckle body 30 of the first seat belt unit 14.

In the described embodiment, the projections 64 and 164 are provided in the vicinity of the openings 52 and 152 of the lower covers 44 and 144 of the first and second seat belt units 14 and 144, respectively. The position of the projections 64 and 164, however, may be located at any other positions along the paths of insertion to insert the insertion portions 28A and 128A of the tongue plates 28 and 128.

What is claimed is:

1. A seat belt system having a plurality of seat belt units with buckle apparatuses each including a tongue plate supporting a webbing and buckle body for locking said tongue plate, comprising:

a first tongue plate having a first insert portion;

a first buckle body having a first insertion path along which said first insert portion is inserted, a first ejector movable in the direction of insertion of said first insert portion by being pushed by said first insert portion thereby being inserted along said first insertion path, and a first lock plate operable by the movement of said first ejector so as to be engaged with said first insert portion thereby locking said first tongue plate;

a second tongue plate having a second insert portion;

a restricted portion provided in said first insertion path and having a width smaller than the width of said second insert portion; and a second buckle unit having a second insertion path along which said second insert portion is inserted, a second ejector movable by a predetermined amount in the direction of insertion of said second insert portion by being pushed by said second insert portion thereby being inserted along said second insertion path, and a second lock plate operable by the movement of said predetermined amount of said second ejector so as to be engaged with said second insert portion thereby locking said second tongue plate, the length of said first insert portion in the direction of insertion and the length of said second ejector in the direction of movement of said second ejector being determined such that, when said first insert portion is inserted into said second insert path, the amount of movement of said second ejector caused by the insertion of said first insert portion is smaller than said predetermined amount.

2. A seat belt system according to claim 1, wherein the lengths of said first and second insert portions in the direction of insertion and the lengths of said first and second ejectors in the direction of movement are determined to meet the following conditions:

length of the direction of first insert portion plus length of the movable direction of first ejector = direction length of second insert portion plus length of movable direction second ejector;

length of the direction of second insert portion > the direction of length of first insert portion; and movable direction length of first ejector > length of movable direction second ejector.

3. A seat belt system according to claim 2, wherein said restricted portion is formed by a pair of mutually opposing projections.

4. A seat belt system according to claim 3, wherein said projections are formed in said first buckle body at positions in the vicinity of entrance of said first insertion path.

5. A seat belt system according to claim 2, wherein said first and second ejectors have first ends which are pressed by the inner ends of said first and second tongue plates as viewed in the direction of insertion so as to be pushed and moved by said first and second tongue plates, said first and second ejectors having second ends opposite to said first ends and capable of operating said first and second lock plates when said first and second ejectors are pushed by said first and second tongue plates.

6. A seat belt system according to claim 5, wherein said first and second insert portions are provided with engaging openings, said first and second lock plates are provided with engaging portions which are engageable with said engaging openings in said first and second insert portions when said first and second lock plates are operated, thereby accomplishing engagement between said first and second lock plates and said first and second tongue plates.

7. A seat belt system according to claim 6, wherein said first and second lock plates are supported by said first and second buckle bodies, respectively, so as to be rocked to bring said engaging portions into engagement with said engaging openings, respectively.

8. A seat belt system according to claim 7, wherein said first and second buckle bodies are provided with disengaging means for disengaging said first and second tongue plates from said first and second lock plates, respectively.

9. A seat belt system according to claim 8, wherein said disengaging means are capable of disengaging said first and second tongue plates from said first and second lock plates, respectively, when pressed into said first and second buckle bodies, respectively.

10. A seat belt system having a plurality of seat belt units with buckle apparatuses each including a tongue plate and a buckle body, said tongue plate being composed of a grip portion supporting a webbing for restraining a vehicle occupant and an insert portion of a width smaller than the grip portion, said buckle body having an ejector movable in the direction of insertion of said insert portion by being pushed by said insert portion, and a lock plate operative by the movement of said ejector so as to lock said tongue plate, comprising:

a first tongue plate having a first insert portion;

a first buckle body capable of locking said first tongue plate;

a first insertion path provided in said first buckle body, said first insert portion being insertable along said first insertion path;

a first ejector having a first opposing surface opposing the distal end of said first insert portion inserted into said first insertion path, and movable in the direction of insertion of said first insert portion as said first surface is pressed by said first insert portion inserted into said first insertion path;

a first lock plate operable by a first opposite surface of said first ejector opposite to said first opposing surface so as to be actuated in response to the movement of said first ejector;

a second tongue plate having a second insert portion;

a second buckle body capable of locking said second tongue plate;

a second insertion path provided in said second buckle unit, said second insert portion being insertable along said second insertion path;

a second ejector having a second opposing surface opposing the distal end of said second insert portion inserted into said second insertion path, and movable in the direction of insertion of said second insert portion as said second surface is pressed by said second insert portion inserted into said second insertion path;

a second lock plate operable by a second opposite surface of said second ejector opposite to said second opposing surface so as to be actuated in response to the movement of said second ejector; and a restricted portion provided in said first insertion path and having a width smaller than the width of said second insert portion;

wherein the length of said first insert portion in the direction of insertion, the length of said second insert portion in the direction of insertion, the distance between said first opposing surface and said first opposite surface and the distance between said second opposing surface and said second opposite surface are determined to meet the following conditions:

length of direction of first insert portion plus distance between first opposing and opposite surfaces = length of direction of second insert portion plus distance between second opposing and opposite surfaces, length of direction of second insert portion > length of direction of first insert portion, distance between first opposing and opposite surface > distance between second opposing and opposite surfaces.

11. A seat belt system according to claim 10, wherein said restricted portion is formed by a pair of opposing projections.

12. A seat belt system according to claim 11, wherein said projections are provided at the entrance of said first insertion path.

13. A seat belt system according to claim 10, wherein said first and second insert portions are provided with engaging openings and said first and second lock plates are provided with engaging portions which are engageable with said engaging openings in said first and second insert portions when said first and second lock plates are operated, thereby accomplishing engagement between said first and second lock plates and said first and second tongue plates.

14. A seat belt system according to claim 13, wherein said first and second lock plates are supported by said first and second buckle bodies, respectively, so as to be rocked to bring said engaging portions into engagement with said engaging openings, respectively.

15. A seat belt system according to claim 14, wherein said first and second buckle bodies are provided with disengaging means for disengaging said first and second tongue plates from said first and second lock plates, respectively.

16. A seat belt system according to claim 15, wherein said disengaging means are capable of disengaging said first and second tongue plates from said first and second lock plates, respectively, when pressed into said first and second buckle bodies, respectively.

17. A seat belt system according to claim 10, wherein said first and second lock plates are normally urged to disengaged from said first and second tongue plates by urging means, respectively.

* * * * *